United States Patent [19]

Kollberg

[11] Patent Number: 4,570,698

[45] Date of Patent: Feb. 18, 1986

[54] METHOD OF AND APPARATUS FOR CENTRIFUGAL CASTING

[75] Inventor: Sten Kollberg, Västerås, Sweden

[73] Assignee: ASEA Aktiebolag, Västerås, Sweden

[21] Appl. No.: 651,292

[22] Filed: Sep. 17, 1984

[30] Foreign Application Priority Data

Sep. 21, 1983 [SE] Sweden ..... 8305084

[51] Int. Cl.[4] ..... B22D 27/02

[52] U.S. Cl. ..... 164/498; 164/114; 164/147.1; 164/298

[58] Field of Search ..... 164/504, 468, 114, 498, 164/147.1, 298

[56] References Cited

U.S. PATENT DOCUMENTS 4,240,494 12/1980 Kryanin et al. ..... 164/114

FOREIGN PATENT DOCUMENTS 0083898 7/1983 European Pat. Off. ..... 164/468
7832622 11/1979 France ..... 164/504
53-43624 4/1978 Japan ..... 164/464
88355 1/1982 Japan ..... 164/147.1

*Primary Examiner*—Nicholas P. Godici
*Assistant Examiner*—Samuel M. Heinrich
*Attorney, Agent, or Firm*—Kenyon & Kenyon

[57] ABSTRACT

The mold is rotated during casting while projecting at least one traveling magnetic stirring field tangentially into the melt so as to rotate melt to the mold speed.

4 Claims, 4 Drawing Figures

FIG. 1
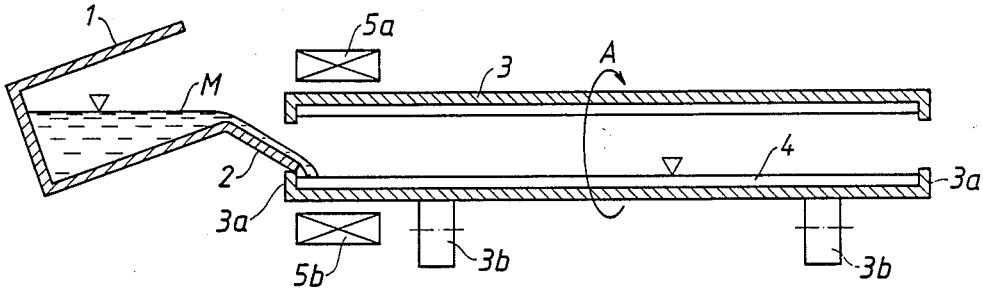
FIG. 2
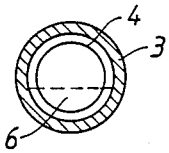
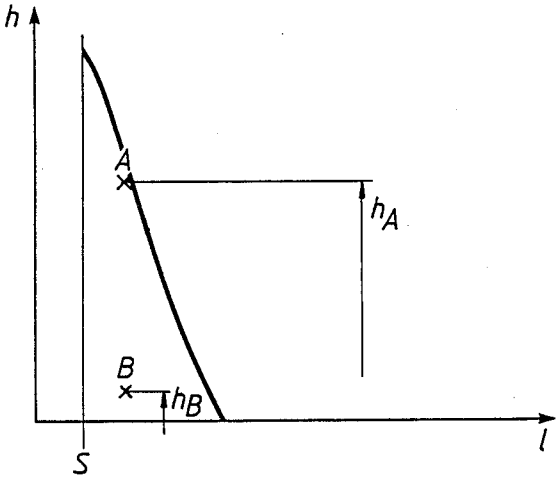
FIG. 3A
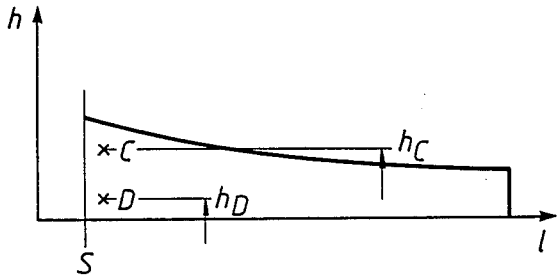
FIG. 3B

METHOD OF AND APPARATUS FOR CENTRIFUGAL CASTING

Molten metal is commonly centrifugally cast into cylindrical tubular shapes such as pipes. Iron and its alloys and other metals can be centrifugally cast.

For centrifugal casting of such shapes a cylindrical rotating mold having inwardly extending end flanges and a controllable rotation speed is used. A melt of molten metal is cast into one end of the rotating mold so as to form a melt volume in the mold providing the desired wall thickness for the cast shape. The rotation speed of the mold must be sufficiently high to cause the melt to centrifugally mold against the inside of the mold. The rotation of the mold is continued until the melt solidifies to form the tubular shape.

The slowest practical mold rotating speed is that which just safely centrifugally holds the melt against the inside of the mold, the maximum possible speed being the highest speed of which the centrifugal mold rotating equipment is capable.

It has been conventional for the foundryman in charge of the casting, to use a mean mold rotating speed or, in other words, to pick a value at least approximately mid-way between the two rotating speed extremes.

This conventional method for centrifugal casting is known to produce the cast shapes with spiral or coil-like grooves, called snakes, and blisters both of which are defects which desireably should be avoided.

One prior art solution is disclosed and claimed by the Sundberg application Ser. No. 563,826 and is based on two observations. First, that when the melt is initially cast and is filling-in the mold, it forms a wave front flowing from the front end of the mold into which the metal is cast, to the other or back end of the mold, the wave front impinging on the mold's flange at the back end so as to propagate a wave motion in the melt in the mold causing the melt to form into a spiral shape in the rotating mold. During filling-in and thereafter the melt does not immediately rotate at the rotating speed of the mold, particularly throughout its inner portion. Therefore, the propagated wave motion can cause a twisting of the melt into the sprial shape which freezes in the portion of the melt in contact with the mold during initial solidification of the melt in the mold. Although the propagated wave motion may thereafter quiet down, a snake remains in the shape's surface after complete solidification of the melt in the mold. Secondly, that the blisters are the result of the cylindrical tubular melt in the rotating centrifugal mold, also solidifying on its inside portion while solidifying on its outside portion held against the inside of the mold.

According to the Sundberg application, to prevent the formation of snakes the mold rotation speed is reduced below the conventional mean rotation speed, during the filling-in of the melt into the mold. This reduces the velocity of the wave front of the melt traveling towards the back end of the mold. The rotation speed must be high enough to keep the melt centrifugally held against the inside of the mold but low enough, below the mean speed, to keep the wave front velocity of the melt low enough so that when the melt reaches the back end flange of the mold there is inadequate wave front energy to propagate a substantial wave back through the melt. After the mold is filled in and with the melt free, or substantially free from wave action, the rotating speed of the mold can be picked-up to the mean speed conventionally used. The solidified casting should be free from snakes.

To avoid the formation of blisters, during solidification the rotating speed of the mold is periodically varied to speeds from slightly above to slightly below the mean speed of rotation. The portion or layer of the melt in contact with the mold varies in speed substantially correspondingly in its rotation speed while the inside or layer-like portion of the melt lags behind in its rotation speed. In other words, when the outer portion of the centrifugally shaped melt cylindrically speeds up, the inner portion through its inertia tends to lag behind, and when the outer portion of the melt slows down the inner portion because of its momentum lags behind in attaining the lower speed. The result is a constant stirring together of the cylindrical tubular melt throughout its wall thickness during solidification, thus avoiding blisters by preventing premature solidification of the inside portion of the melt.

According to the present invention the continuous casting mold is made of non-magnetic metal such as austenitic steel but may otherwise be of conventional construction and supported by controllable speed rotating rollers as usual. A characterizing difference is that on the outside at the front end of the mold into which the melt is poured, at least one electromagnetic stirrer is rigidly positioned and powered with multi-phase AC so as to project inside of the mold at its front end a traveling field moving tangentially with respect to the inside periphery of the mold and in the same direction as the mold is rotated. If only one stirrer is used it should preferably be positioned below the outside of the front end of the mold and preferably there should be one other stirrer positioned above that end of the mold. The stirrers may be designed similar to the design of electromagnetic strand stirrers used in continuous steel casting systems. The traveling multi-phase field of such a stirrer induces a strong circumferential thrust or drive on molten metal within the field. The field or fields should not radially extend beyond the center of the mold. The stirrer thrust or drive should be on the melt on the periphery of the inside of the mold and in a tangential direction.

With the mold rotating at the previously mentioned mean rotating speed, for example, and the stirrer field or fields traveling in the same direction as that of the mold and preferably at a velocity substantially equal to the circumferential velocity of the mold's inside, the melt is poured or cast into the front end of the mold preferably as rapidly as possible. As the melt enters the stirrer field or fields at the front end of the mold, it is immediately driven rotatively to the rotating speed of the mold. Thereafter the mold continues the melt rotation at the same speed until the mold is filled.

A force directed axially towards the other end of the mold is created by the centrifugal force of the melt, which is proportional to the centrifugal force on the melt times the pressure height of the melt in the mold. The centrifugal force is 50–100 g when the melt rotation is syncronous with the mold and the latter is rotating at its mean rotating speed. Therefore the normal gravity force on the melt is negligible.

Because the melt is magnetically driven to the mold rotating speed immediately upon entering the mold an axial distribution of the melt along the mold's length is effected much faster than can be effected by solely relying on the melt being rotated only by its contact with the rotating mold's inside. The rapidity of this axial distribution causes the melt throughout the length of the mold to almost immediately achieve a uniform height for thickness as the melt is being poured into the front end of the mold, this thickness increasing until the finally desired casting thickness is obtained. The melt continuously rotates substantially at the same rotating speed as that of the mold throughout the mold's length, and its solidification therefore does not result in the spiral or coil-like grooves or snakes. With the present invention the mold rotation speed need not be reduced below the conventional mean rotation speed during the filling-in of the melt in the mold. The melt substantially immediately rotates at the rotating speed of the mold throughout its inner portion as well as its outer portion directly contacting the inside of the mold. Therefore, there is no twisting action on the melt such as might twist the melt into a spiral shape.

To avoid blisters, during solidification after the desired amount of melt is poured into the rotating mold the rotation speed of the mold can be periodically varied to speeds from slightly above to slightly below the mean speed of rotation, as described by the Sundberg application.

A more detailed description of the principles of the invention is given below with the aid of the accompanying draw-ings in which:

FIG. 1 in vertical longitudinal section shows the centrifugal casting mold and the stirrers positioned at its front end with the melt filling-in just about completed;

FIG. 2 is a vertical cross section showing the mold and indicates the pool of melt initially formed at its front end with fast initial charging of the mold with the melt in the case of conventional continuous casting;

FIG. 3A is a graph showing the relation between the melt height and tube length for conventional centrifugal casting; and FIG. 3B is a graph showing that relationship in the case of the present invention.

In FIG. 1 the casting operation is just about completed. The melt M poured from the ladle 1 via the spout 2 into the front end of the mold 3 having end flanges 3*a*, has been uniformly distributed throughout the length of the mold between its end flanges as indicated at 4. The mold rotation is indicated by the arrow A, the mold being rotatively driven by being supported on controllable speed drive rollers 3*b*. Two diametrically positioned stirrers 5*a* and 5*b* are rigidly positioned on the outside of the front end of the mold and were operated during the entire filling-in so as to project through the mold 3 into the melt rotating fields traveling in the same direction as the mold's rotation direction, as indicated by the arrow A, the mold 3 being made of non-magnetic metal as exemplified by autenitic steel. Preferably the rotating speed of the stirrers field was substantially synchronized with the rotating speed of the mold 3 to prevent eddy current losses.

The stirrer 5*b* is directly below the front end of the stirrer so its field travels tangentially in the inside of the bottom of that end. As the first of the casting melt falls to the mold's bottom it is in this field and driven circumferentially up the mold's rotating inside into the field of the stirrers 5*a* above the mold. The melt's centrifugal force drives it axially towards the other end of the mold.

In the prior art or conventional practice the melt if poured rapidly into the rotating mold 1 initially forms at the mold's front end a pool as indicated at 6 in FIG. 2. Rotation of this pool depends on the friction between it and the inside of the mold and melt rotation starts slowly, providing little centrifugal force to drive the melt axially.

With the stirrers 5*a* and 5*b* operating as described such a pool does not have the opportunity to form. As the melt enters the mold it is almost immediately driven by the rotating stirrer fields to the rotating speed of the mold 3 which is normally its mean mold rotating speed. The centrifugal force on the melt is immediately some 50–100 g. As one example, a mold with an inside radius of 0.1 m might be rotating at 1,000 rpm when at a typical mean rotating speed.

Other unillustrated forms of stirrer or stirrers might be used as exemplified by a circular stirrer enclosing the outside of the front end of the mold. The important thing is to project a traveling magnetic field through the front end of the mold so as to immediately drive the incoming melt, during its pouring, to the rotating speed of the mold. Because the incoming melt is so immediately rotated by the stirrer field or fields to the mold's rotating speed it is possible to pour the melt in at a much faster casting rate than that practiced conventionally, without forming the pool indicated at 6 in FIG. 2 The centrifugal force on the melt drives the melt axially almost immediately to the back end of the mold. This results in the mold filling-in with a height, or wall thickness, that is uniform throughout the mold's length. The formation of a snake in the final casting is avoided.

After the mold is filled so as to provide the desired wall thickness of the final product, the rotation of the mold may be varied in rotating speed slightly above to slightly below the mean mold rotating speed so as to stir the inner surface of the cast shape to avoid blisters. This practice is described by the previously mentioned Sundberg application.

The prior art practice resulting in the initial formation of the pool 6 indicated by FIG. 2, is graphically shown by FIG. 3A. The melt height h is vertical and the tube length l is horizontal and the pouring or casting of the melt starts at S and at a certain time thereafter as at A the melt is starting to rotate slowly, the axial force being about only natural gravity times the height $h_A$. At point B the melt has started rotating with the mold and an axial force 50 $g \times h_B$ is obtained. It is assumed that the mold is rotating at its normal mean rotating speed and of course the stirrers 5*a* and 5*b* are either not present or are unpowered.

FIG. 3A shows how the melt height at the front of the mold becomes high during casting and only later then receives the centrifugal force required to drive the melt axially. At first the melt rotates slowly and then increases to the mold speed, resulting in a snake in the final casting.

On the other hand, as shown by FIG. 3B, using the present invention, starting at S the melt is rotated substantially to mold rotating speed at point C and closely thereafter at the full mold speed at D, the axial force on the melt being about 50 $g \times h_C$ and 50 $g \times h_D$, respectively. At the point D where the melt has advanced from within the field of the stirrers only a part of the melt is being rotatively driven by the stirrer field or fields, depending on the depth of the penetration of the stirrer field or fields. However, at the point D the melt is already rotating at the mold rotating speed, the melt thereafter continuing its rotation by the action of the rotating mold. The melt is axially driven by the melt's centrifugal force to the back end of the mold with a uniform depth or wall thickness, throughout the length of the melt, as shown at 4 in FIG. 1.

In the foregoing it is to be understood that the melt is poured into the front end of the mold at a level below the axial center line of the rotating centrifugal mold. The traveling magnetic field or fields should not extend radially substantially beyond this center line.

What is claimed is:

1. A method for centrifugal casting by a rotating centrifugal casting mold, comprising projecting a traveling magnetic field into the front end of the mold, the field traveling tangentially with respect to the inside periphery of the mold and in the same direction and at substantially the same velocity as said periphery is rotating, and while said field is maintained pouring a melt into the front end of the mold, the melt from start to finish of the pouring being substantially immediately driven to the same velocity of the mold's inside periphery and forming a substantially uniform wall thickness until the melt fills-in the mold, said field being projected into the mold from its front end to not more than the longitudinal center of the mold.

2. The method of claim 1 in which the pouring is so rapid that without said field the melt would form a pool in the front end of the rotating mold, said field causing substantially immediate rotation of the melt so as to prevent the formation of such a pool.

3. A centrifugal casting apparatus comprising a rotative centrifugal casting mold made of non-magnetic metal and having a front end through which a melt is poured for casting, means for rotating the mold in one direction, and at least one electromagnetic stirrer means on the outside of the mold's front end only and extending to not more than the longitudinal center of the mold, and positioned to project a traveling magnetic field through the mold and tangentially into melt poured through the mold's front end at a speed substantially the same as the speed of the rotative mold and in said one direction.

4. The apparatus of claim 3 in which the stirrer is positioned below the bottom of the mold's front end.

* * * * *